US011258221B2

(12) United States Patent
Lau et al.

(10) Patent No.: US 11,258,221 B2
(45) Date of Patent: Feb. 22, 2022

(54) ROTATABLE AND WET-MATEABLE CONNECTOR

(71) Applicant: Oliden Technology, LLC, Stafford, TX (US)

(72) Inventors: Ting Lau, Houston, TX (US); Zhichao Gong, Richmond, TX (US)

(73) Assignee: Oliden Technology, LLC, Stafford, TX (US)

( * ) Notice: Subject to any disclaimer, the term of this patent is extended or adjusted under 35 U.S.C. 154(b) by 61 days.

(21) Appl. No.: 16/510,496

(22) Filed: Jul. 12, 2019

(65) Prior Publication Data

US 2021/0013687 A1 Jan. 14, 2021

(51) Int. Cl.

| | |
|---|---|
| ***H01R 35/04*** | (2006.01) |
| ***H01R 13/52*** | (2006.01) |
| ***H01R 43/00*** | (2006.01) |
| ***H01R 43/26*** | (2006.01) |

(52) U.S. Cl.

CPC ..... *H01R 35/04* (2013.01); *H01R 13/5213* (2013.01); *H01R 13/5219* (2013.01); *H01R 13/5227* (2013.01); *H01R 43/002* (2013.01); *H01R 43/26* (2013.01)

(58) Field of Classification Search

CPC ..... H01R 35/04; H01R 43/002; H01R 43/26; H01R 13/5213; H01R 13/5219; H01R 13/5227

See application file for complete search history.

(56) References Cited

U.S. PATENT DOCUMENTS

| | | | | |
|---|---|---|---|---|
| 4,188,084 | A | 2/1980 | Buresi | |
| 4,500,156 | A | 2/1985 | Nguyen | |
| 4,997,384 | A | 3/1991 | Godfrey | |
| 5,131,464 | A | 7/1992 | Lenhart | |
| 5,823,257 | A | 10/1998 | Peyton | |
| 6,004,172 | A * | 12/1999 | Kerek | H01R 13/10 439/879 |
| 6,415,869 | B1 | 7/2002 | Smith | |
| 7,074,064 | B2 | 7/2006 | Wallace | |
| 7,566,235 | B2 | 7/2009 | Bottos | |
| 8,308,167 | B2 * | 11/2012 | Balsells | A61B 17/162 279/23.1 |

(Continued)

*Primary Examiner* — Abdullah A Riyami
*Assistant Examiner* — Nader J Alhawamdeh
(74) *Attorney, Agent, or Firm* — Bryan L. White

(57) ABSTRACT

A mating connector that is rotatable and wet-mateable is disclosed herein. The connector has mating components that can be characterized as male and female. The connector may have one or more electrical and/or non-electrical contacts. As used herein, "wet-mateable" or "wet-connectable" means proper mating of the male and female components can be achieved even in the presence of conductive fluid. Being rotatable means the male and female components can be rotated independently during the mating process. A male component of a rotatable and wet-mateable mating connector is provided that has conductive and non-conductive sealing elements. A female component of the rotatable and wet-mateable mating connector is provided having conductive elements that are complementary to the male component. The male component is inserted into a chamber within the female component to produce the rotatable and wet-mateable mating connector.

32 Claims, 6 Drawing Sheets

(56) References Cited

U.S. PATENT DOCUMENTS

| | | | | |
|---|---|---|---|---|
| 8,752,635 | B2 * | 6/2014 | Wang | E21B 17/1035 166/380 |
| 9,466,916 | B2 * | 10/2016 | Li | E21B 17/028 |
| 10,000,995 | B2 | 6/2018 | Bishop | |
| 10,186,805 | B2 * | 1/2019 | DeWitt | H01R 13/6277 |
| 2001/0030972 | A1 | 10/2001 | Donaghey | |
| 2015/0122478 | A1 | 5/2015 | Partouche | |
| 2016/0305214 | A1 | 10/2016 | Bishop | |
| 2018/0138633 | A1 * | 5/2018 | DeWitt | H01R 13/6277 |

* cited by examiner

ROTATABLE AND WET-MATEABLE CONNECTOR

CROSS-REFERENCE TO RELATED APPLICATIONS

N/A

BACKGROUND OF THE DISCLOSURE

In the oil and gas industry, downhole measurement and logging tools are generally connected in series to form an interconnected suite of tools used while drilling. Electrical power and data are commonly passed from one tool to another. Such tools are typically mounted to and housed within the interior regions of drill collars. At the wellsite the drill collars are themselves joined end-to-end (typically using "box and pin" threaded connectors) to form a bottom-hole assembly to convey the various tools into the wellbore.

It has proved useful to have electrical connectors that are both rotatable and wet-mateable. Existing rotatable, wet-mateable electrical connectors in the oil and gas industry generally fall into one of two main categories. One such category uses elastomeric molded male and/or female connectors with no moving or replaceable parts. See, for example, U.S. Pat. No. 4,500,156 issued to Nguyen. In that invention, the male connector acts as plunger, expelling any fluid present in the female cavity through a weep hole at or near one end of a cavity. The surrounding elastomer provides the necessary sealing and electrical insolation. This design allows for compact design, but is generally non-serviceable at the wellsite. The number of life cycles is limited due to contaminant buildup at the female contact(s), and abrasion on the elastomer during insertion can cause fluid leakage and, hence, electrical shorts between contacts should there be more than one. The number of electrical contacts is typically only one or two.

The other main category uses a female connector in conjunction with a dry mating chamber, properly sealed to prevent fluid invasion. Generally, the female connector comprises individual contacts with isolating elements and a spring-loaded retractable plunger guarding the mating chamber. This design allows for minimal abrasion on the contacts during insertion. It also provides good electrical isolation between contacts. However, it is typically expensive and leads to excessive tool length. Maintenance is difficult, in part because of a large number of moving parts, but also because it must be performed in a clean, controlled environment. Contaminant buildup inside the female cavity requires more frequent service intervals.

Conventional electric connectors rely on metal-to-metal interaction at discrete points or lines secured by springs or some form of mechanical interference. These contacts are either non-serviceable or very difficult to replace. Because of their mechanical nature, they tend to wear out and/or the mating surfaces are damaged quite easily.

SUMMARY

A mating connector that is rotatable and wet-mateable is disclosed herein. The connector has mating components that can be characterized as male and female. The connector may have one or more electrical and/or non-electrical contacts. As used herein, "wet-mateable" or "wet-connectable" means proper mating of the male and female components can be achieved even in the presence of conductive fluid. Being rotatable means the male and female components can be rotated independently during the mating process. A male component of a rotatable and wet-mateable mating connector is provided that has conductive and non-conductive sealing elements. A female component of the rotatable and wet-mateable mating connector is provided having conductive elements that are complementary to the male component. The male component is inserted into a chamber within the female component to produce the rotatable and wet-mateable mating connector.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion. Embodiments are described with reference to the following figures. The same numbers are generally used throughout the figures to reference like features and components.

DETAILED DESCRIPTION

Figure 1:
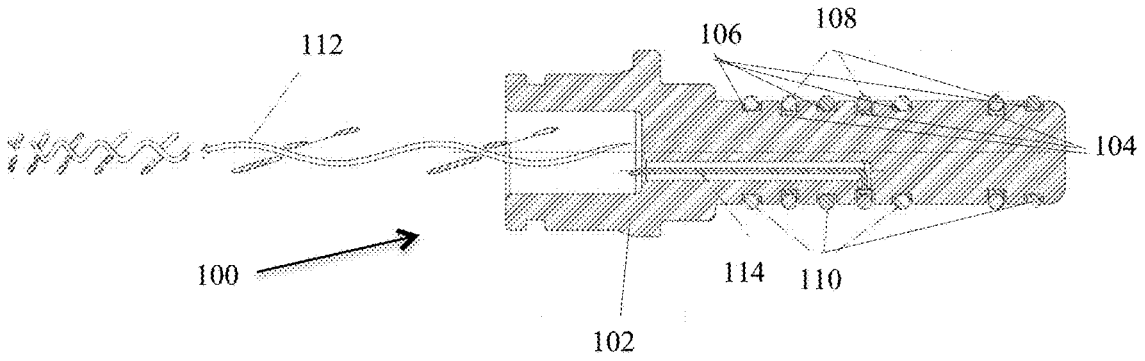
FIG. 1 is cross-sectional schematic drawing of one embodiment of a male component of a mating connector, in accordance with the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Some embodiments will now be described with reference to the figures. Like elements in the various figures may be referenced with like numbers for consistency. In the following description, numerous details are set forth to provide an understanding of various embodiments and/or features. However, it will be understood by those skilled in the art that some embodiments may be practiced without many of these details and that numerous variations or modifications from the described embodiments are possible. As used here, the terms "above" and "below", "up" and "down", "upper" and "lower", "upwardly" and "downwardly", and other like terms indicating relative positions above or below a given point or element are used in this description to more clearly describe certain embodiments. However, when applied to equipment and methods for use in wells that are deviated or horizontal, such terms may refer to a left to right, right to left, or diagonal relationship, as appropriate. It will also be understood that, although the terms first, second, etc. may be used herein to describe various elements, these elements should not be limited by these terms. These terms are only used to distinguish one element from another.

The terminology used in the description herein is for the purpose of describing particular embodiments only and is not intended to be limiting. As used in the description and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, steps, operations, elements, and/or components, but do not preclude the presence or addition of one or more other features, steps, operations, elements, components, and/or groups thereof.

As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context.

Making reliable electrical connections between tools for while-drilling applications can present significant design challenges such as limited space availability and operability in high temperatures (e.g., 150° C. or greater). Other design considerations include, but are not limited to, ruggedness, low cost, and ease of maintenance, even in adverse conditions. The rotatable, wet-mateable connector disclosed herein saves time and mitigates operator errors by simplifying wellsite tool preparation and configuration assembly and also serviceability of the connector itself. The rotatable connector gives designers greater flexibility in usage and placement. In such connectors both mechanical and electrical connections occur substantially simultaneously. A wet-connector (also known as wet-mateable connector) permits the mating of the connector components in the presence of conductive fluid such as impure water or drilling fluid (mud) by expelling fluid from the mating cavity and preventing fluid invasion into the chamber.

An apparatus and method to provide a mating connector that is rotatable and wet-mateable is disclosed herein. The connector has mating components that can be characterized as male and female. The connector has one or more electrical contacts and one or more non-electrical contacts. As used herein, "wet-mateable" or "wet-connectable" means proper mating of the male and female components can be achieved even in the presence of conductive fluid. Being "rotatable" means the male and female components can be rotated independently (i.e., relative to one another) during the mating process.

In one embodiment, a female component comprises a one-piece molded assembly with contact rings, hookup wires, and certain external features to aid alignment and installation. Choice of molding compound may vary depending on application and temperature requirements. For example, thermoplastics (e.g., PEEK) or fiberglass composites may be used. After molding, secondary machining may be done to ensure the mating cavity is cylindrical and its surface smooth enough for O-ring sealing. The inner diameter surface of embedded contact rings is exposed to the connector's central cavity and is an integral part of the cavity's inner wall. For critical applications the electrically conductive surface of the contact ring may be gold plated. Hookup wires in electrical connection with the contact rings are encapsulated up to their exit point at one end of the connector. A weep hole at the bottom of the cavity provides an escape route for any trapped fluid.

Similarly, a mating male component is also a molded assembly with no moving parts (other than perhaps a rotational degree of freedom of the conductive O-ring). The molding compound does not have to be identical to its female counterpart, but many of the same considerations apply. On the male component's external surface there may be one or more O-ring glands (a sleeve used to produce a seal around a shaft) with widths and depths appropriate for the pre-selected O-ring sizes. The glands that correspond to electrical contacts have conductive (e.g., metallic) surfaces, preferably gold-plated but generally the same as the corresponding female contact ring. The desired conductive surfaces can be obtained, for example, by heavy plating over the plastic/composite base material or by embedding metal rings. Each conductive gland is preferably "sandwiched" between non-conductive glands, but one non-conductive gland is sufficient, as described below. For example, a connector with three electrically conductive glands may have a total of seven glands with three conductive glands at the "2nd", "4th", and "6th" positions, respectively, and four non-conductive glands at the "1st", "3rd", "5th", and "7th" positions, respectively. This creates insulating barriers between electrical contacts. Secondary machining after molding may be performed to satisfy surface finish and tolerance requirements. Hookup wires to the male component's conductive rings/surfaces are encapsulated up to their exit end of the connector.

Elastomeric O-rings made with non-conductive material such as VITON, silicone, or HNBR are installed on the non-conductive glands. One or more conductive O-rings (e.g., an elastomer with a conductive filler such as silver-plated aluminum, an elastomeric core metallized on the outer diameter surface, a core spiral wrapped with a metallic strip, or an expandable metallic ring that can be installed and deployed like an elastomeric ring) may be installed on each conductive gland. The non-conductive O-rings provide very good fluid and electrical isolation between contacts axially, while the conductive O-rings provide electrical continuity radially between corresponding male and female electrical contacts.

The smooth, uniform cylindrical female cavity, substantially void of any protrusions or irregularities, keeps contaminant buildup to a minimum, facilitates the removal of fluid trapped in the chamber, and further facilitates cleaning. During insertion, the leading O-ring on the male component acts as a plunger, pushing out any trapped fluid through a weep hole and, at the same time, wiping clean the female contact surfaces.

The conductive O-rings can be replaced and conductive glands cleaned in short order. If the conductive O-ring is elastomeric, it is relatively non-abrasive. In addition to being gentle on the mating surfaces, it maintains a 360 degree surface-to-surface contact. This allows for relative rotation between male and female counterparts without loss of conductivity. While it is conceivable that small amounts of conductive fluid can be trapped in the void space of the O-ring glands, that will not be an issue if the electrical contacts are isolated from other electrical contacts by adjacent non-conductive O-rings (i.e., no conductive path between electrical contacts).

FIG. 1 shows one embodiment of a mating connector male component 100. The male component 100 comprises a male body 102 having seven O-ring glands, three of which are conductive glands 104, and four of which are non-conductive glands 106. More or fewer glands are possible. Each of the conductive glands 104 traps a conductive O-ring 108, and each non-conductive gland 106 traps a non-conductive O-ring 110. In this embodiment each conductive gland 104 has a non-conductive gland 106 on either side of it (i.e., axially offset). The O-ring glands 104, 106 are all disposed on and fixed relative to the male body 102. Likewise, conductive O-rings 108 and non-conductive O-rings 110 are substantially fixed relative to the male body 102. That is to say, male component 100 has no moving parts (other than perhaps a rotational degree of freedom for an O-ring). FIG. 1 also shows a set of hookup wires 112 and one of the hookup wire connectors 114 electrically connected to a conductive gland 104. Each conductive gland 104 is similarly connected to its corresponding hookup wire 112 via its corresponding hookup wire connector 114.

Contact elements such as conductive O-rings 108 and non-conductive O-rings 110 are removable and therefore easily replaced. In addition, when the connector 300 (see FIG. 3) is mated, non-conductive O-rings 110 provide fluid isolation barriers, thereby precluding electrical shorting via fluid migrating into regions housing the electrically conductive O-rings 108. As further described below, when the male and female connector components mate, fluid is simultaneously expelled from the mating cavity through a weep hole 210 (see FIG. 2), affording a higher level of connectability in a wet environment.

Figure 2:
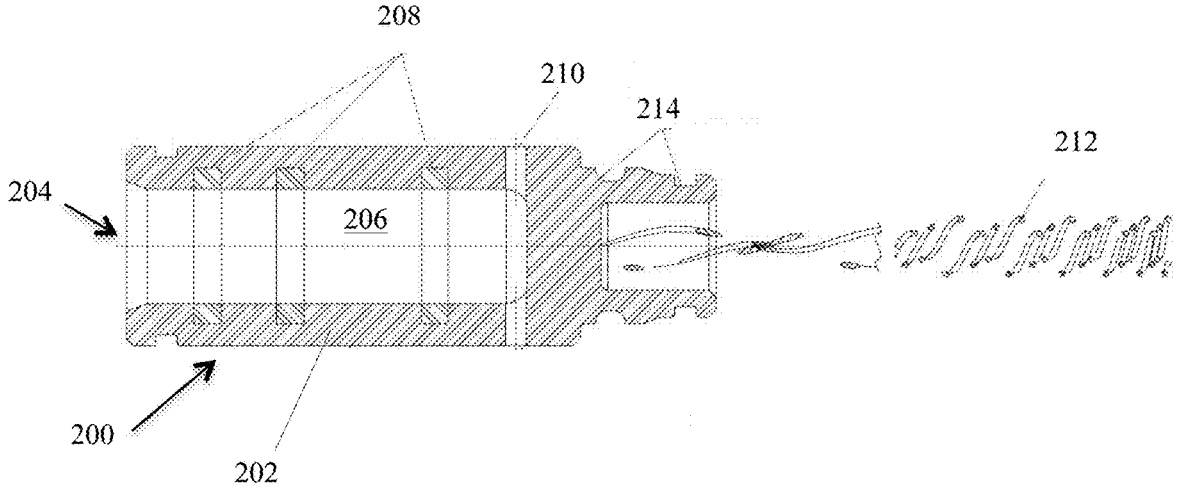
FIG. 2 is cross-sectional schematic drawing of one embodiment of a female component of the mating connector of FIG. 1, in accordance with the present disclosure.

FIG. 2 shows a mating connector female component 200 corresponding to the male component 100 embodiment of FIG. 1. The female component 200 comprises a female body 202 having an open end 204 and an interior chamber 206. Embedded in female body 202 and integral to the wall of the interior chamber 206 are three contact rings 208. More or fewer contact rings are possible. Thus, female component 200, like its male counterpart 100, has no moving parts. Female body 202 has a weep hole 210 at or near the end of chamber 206 opposite the open end 204. Contact rings 208 are likewise protected from fluid incursion by non-conductive O-rings 110 when the connector 300 (see FIG. 3) is mated. A set of hookup wires 212 is shown. While not expressly shown in FIG. 2, each contact ring 208 is connected to a corresponding hookup wire 212. Female body 202 has certain external features 214 that aid in the mounting and sealing of the connector 300.

Figure 3:
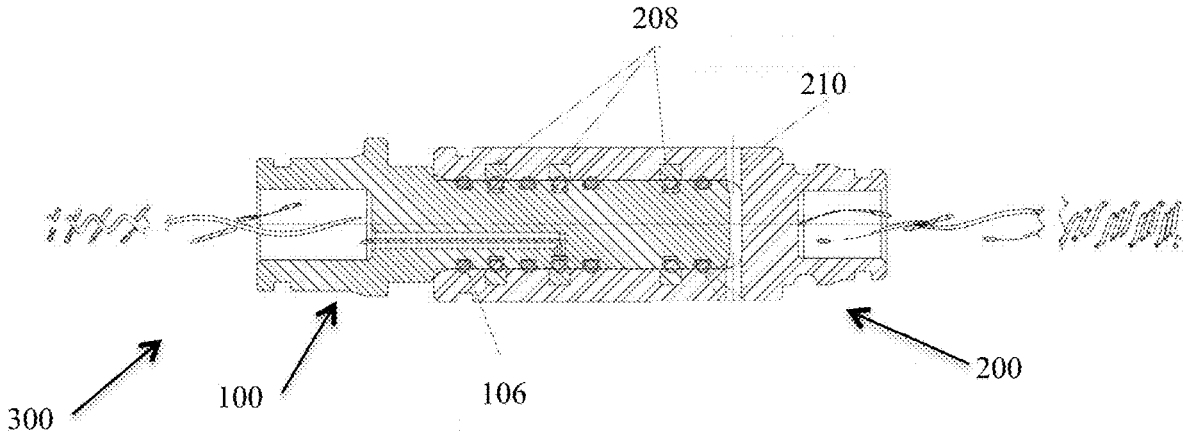
FIG. 3 is cross-sectional schematic drawing of one embodiment of the male component of FIG. 1 and the female component of FIG. 2 in their connected configuration, in accordance with the present disclosure.

FIG. 3 shows the male component 100 of FIG. 1 and the female component 200 of FIG. 2 in their combined or mated configuration, thereby forming connector 300. Corresponding elements of male component 100 and female component 200 are shown in their aligned state. In particular, each contact ring 208 is paired and in electrical contact with its corresponding conductive gland 104 via conductive O-ring 108. Each contact ring 208/conductive O-ring 108/conductive gland 104 assemblage, in conjunction with corresponding hookup wires 112, 212, forms an electrically conductive path through connector 300, allowing transfer of electrical power and/or data (i.e., electrical signal) through the tool train (i.e., bottomhole assembly). Non-conductive O-rings 110, in conjunction with non-conductive glands 106, are in sealing engagement with the wall of interior chamber 206. As stated above, these provide electrical and fluid isolation to the contact ring 208/conductive O-ring 108/conductive gland 104 assemblages.

While the embodiments shown in FIGS. 1, 2, and 3 have multiple contact ring 208/conductive O-ring 108/conductive gland 104 conductive assemblages and multiple non-conductive gland 106/non-conductive O-ring 110 sealing assemblages, only one of each such assemblages is required. That is, a non-conductive gland 106/non-conductive O-ring 110 pair can be placed at the leading end of male component 100 (i.e., the portion to first enter chamber 206), and a conductive O-ring 108/conductive gland 104 pair can be placed "behind" the non-conductive gland 106/non-conductive O-ring 110 pair on male component 100. A corresponding contact ring 208 is disposed in female component 200. Such an arrangement ensures fluid is expelled from chamber 206 and contact ring 208 is wiped clean when making up the connector 300, and will prevent fluid incursion via the weep hole once the tool is deployed into the wellbore. An alternative sealing means (not shown) may be used at or near the opening 204, but this is not necessarily crucial if there is only one electrical contact since there are no other electrical pathways by which the electrical circuit can be shorted.

In operation, a male connector component 100 and a female connector component 200 are provided at a wellsite. Alternatively, male components 100 and female components 200 may be pre-installed in tools intended to be disposed in a wellbore. At the wellsite a drillstring is fabricated using drillpipe and drill collars housing various downhole tools forming a bottomhole assembly. Each tool (or group of interconnected tools within a drill collar) is a modularized unit, typically requiring electrical connection above and below when mechanically assembled into the bottomhole assembly. For those tools in the bottomhole assembly requiring electrical connectivity (e.g., for data or power transmission), male connectors 100 and female connectors 200 may be attached to the tools, if not already installed, to facilitate the needed electrical connections.

Figure 4:
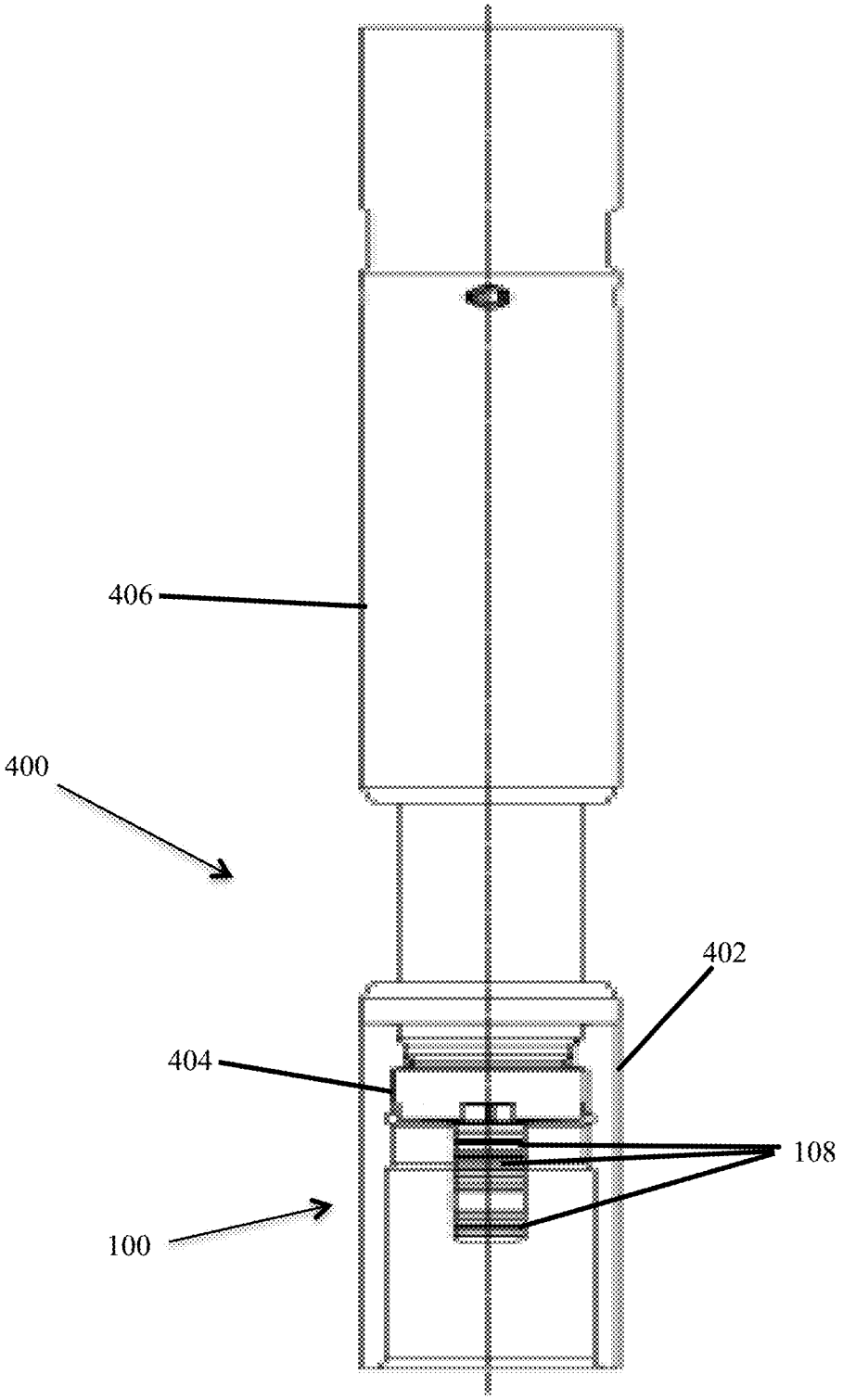
FIG. 4 is a schematic view of one embodiment of a male connector assembly shown with a portion of a sleeve removed to expose its interior, in accordance with the present disclosure.

FIG. 4 shows one embodiment of a male connector assembly 400 for an inter-tool (or inter-module) downhole logging tool (or downhole measurement tool) system used in oil and gas exploration. FIG. 4 shows the male component 100 disposed in a sleeve 402. In this embodiment the sleeve 402 is trapped by a nut 404, securing sleeve 402 and male component 100 to a male chassis connector 406. Each downhole tool or module typically has a structural member called a "chassis" on which instrumentation is mounted. The chassis, in conjunction with the drill collar in which the tool is mounted, helps makes the tool capable of withstanding the extreme downhole conditions typically encountered. The male connector assembly 400 shown in FIG. 4, comprising male chassis connector 406 and male component 100, is connected via male chassis connector 406 to one end of a downhole tool chassis (not shown) by conventional means (e.g., threaded connector). For example, male chassis connector 406 may be joined to the lower end of a downhole tool chassis, thereby locating male component 100 near the lower end of the enclosing drill collar, ready to be mated to a female component 200 mounted similarly on the upper end of the next tool lower in the bottomhole assembly. Of course, a reciprocal arrangement could also be configured (i.e., female component 200 above, male component 100 below).

Figure 5:
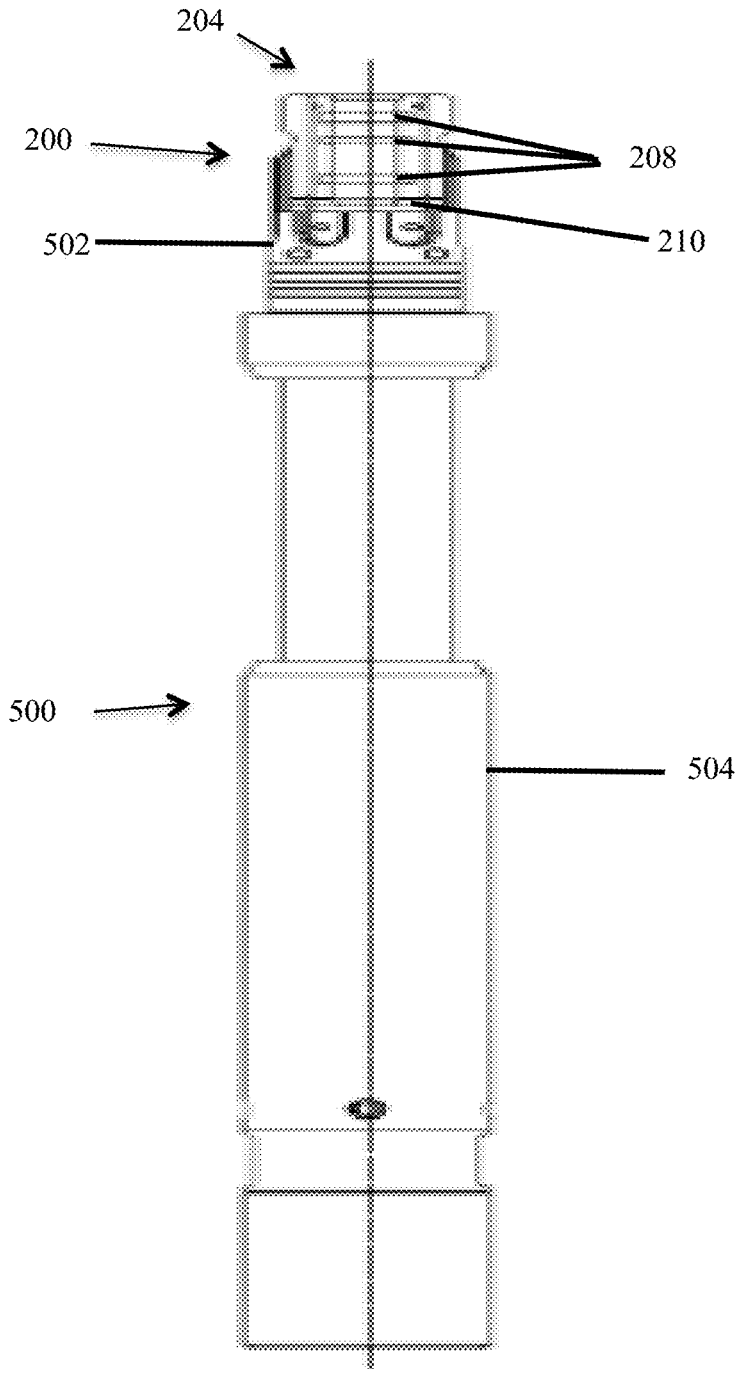
FIG. 5 is a schematic view of one embodiment of a female connector assembly, in accordance with the present disclosure.

FIG. 5 shows a counterpart female connector assembly 500 for an inter-tool (or inter-module) downhole logging tool (or downhole measurement tool) system. Female component 200 is disposed in housing 502. Housing 502 is complementary to sleeve 402 and sealingly fits within the interior of sleeve 402. Housing 502 is secured to female chassis connector 504. Female chassis connector 504 allows for connection of female connector assembly 500 to a tool chassis in the same or similar manner as described above for male connector assembly 400. In LWD (Logging While Drilling) or MWD (Measurement While Drilling) operations, the male and female connector assemblies 400, 500 are each joined to the extremities of respective adjacent tools (modules) and centralized within their respective drill collars.

Figure 6:
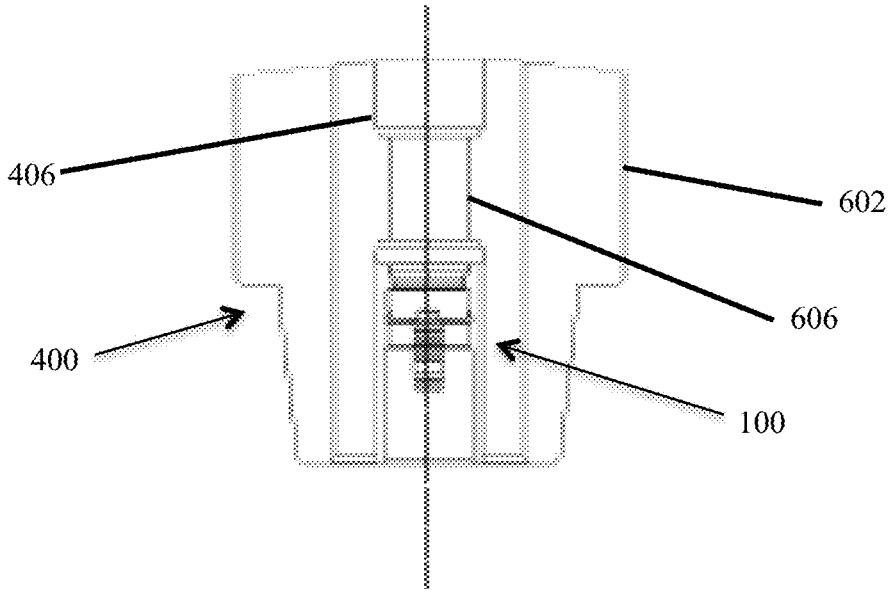
FIG. 6 is a schematic view of one embodiment of the male connector assembly of FIG. 4 and the female connector assembly of FIG. 5 as an upper drill collar approaches a lower drill collar, just prior to being joined, in accordance with the present disclosure.
Figure 6:
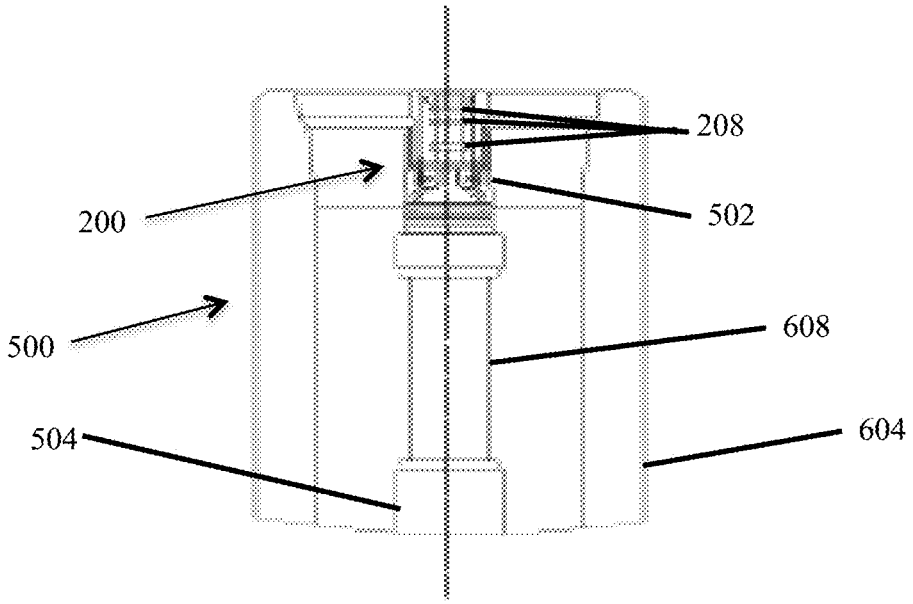

FIG. 6 shows a male connector assembly 400 and a female connector assembly 500 in close proximity to one another just prior to being joined. Male connector assembly 400 is joined to the lower end of a first chassis (not shown) via male chassis connector 406. The first chassis is disposed in and secured to upper drill collar 602. Similarly, female connector assembly 500 is joined to the upper end of a second chassis (not shown) via female chassis connector 504. The second chassis is disposed in and secured to lower drill collar 604. As the upper drill collar 602 and the lower drill collar 604 are rotatingly threaded together (i.e., making up the bottomhole assembly, just prior to "tripping in" or running into the hole), the male and female connectors 100, 200 make up (i.e., join) simultaneously, both mechanically and electrically. That is, housing 502 rotatingly slides into sleeve 402 and male component 100 rotatingly slides into female component 200. As male component 100 enters through open end 204 and penetrates chamber 206, fluid in chamber 206, if any, is displaced and ported to the exterior via weep hole 210. Contact rings 208 are wiped clean as male component 100 moves into chamber 206. When first and second drill collars 602, 604 are fully landed, male component 100 is fully inserted in and properly aligned with female component 200. Conductive O-rings 108 make electrical connection with contact rings 208, creating the desired electrical pathways. Non-conductive O-rings 110 are in sealing engagement with the wall of chamber 206, thereby preventing fluid incursion into chamber 206 and isolating electrical contact elements 104, 108, 208.

To ensure such proper alignment and to allow for variations such as that due to thermal expansion, male connector assembly 400 has a male sliding member 606 and female connector assembly 500 has a female sliding member 608. Each of those sliding members 606, 608 can telescopically move axially relative to its respective chassis connector 406, 504. Those sliding members 606, 608 can be held in place, for example, by springs that provide a force bias but also allow for relative motion in response to external forces.

Should an O-ring contact element 108, 110 become worn or otherwise damaged, it can easily be removed and replaced, even in the field. In operation at the wellsite, the damaged O-ring 108, 110 is simply removed and a new conductive O-ring 108 or non-conductive O-ring 110, as the case may be, is placed on male body 102 at the proper corresponding location. In one example scenario, an otherwise working drillstring containing a defective rotatable and wet-mateable mating connector 300 is removed from a wellbore. When the drill collars 602, 604 containing the defective rotatable and wet-mateable mating connector 300 are disassembled on the rig floor, the male connector assembly 400 is exposed. Nut 404 can be removed to release sleeve 402, allowing access to male component 100. Any defective contact elements such as conductive O-ring 108 or non-conductive O-ring 110 can be removed and replaced. The drill collars 602, 604 can then be reassembled, and, in doing so, rotatable and wet-mateable mating connector 300 is simultaneously remade and ready to return downhole with re-established electrical connections and/or seals.

While specific embodiments disclosed herein describe particular structural elements and materials, non-standard materials or non-circular cross-sections, as well as other sealing elements/techniques, may also be used.

Figure 7:
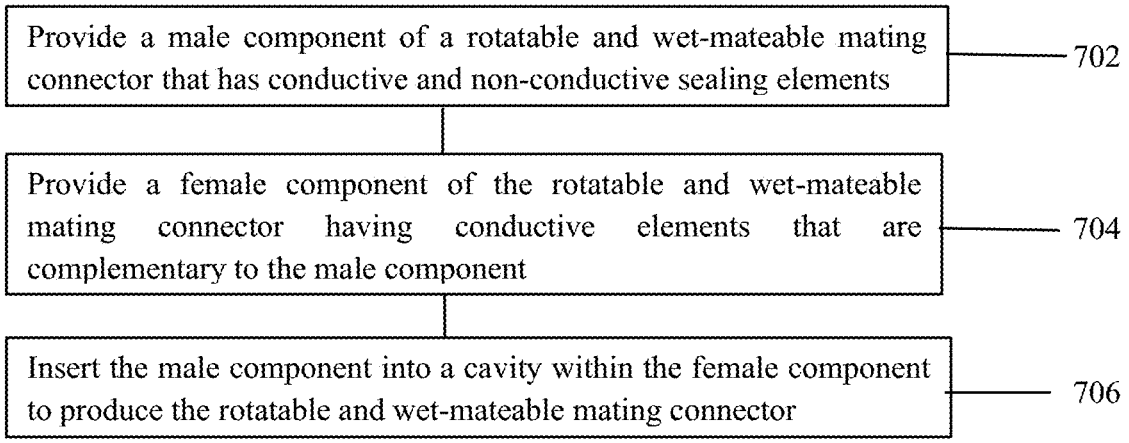
FIG. 7 is a flowchart to produce a rotatable and wet-mateable mating connector, in accordance with the present disclosure.

FIG. 7 shows a flowchart illustrating an embodiment in accordance with this disclosure. In this embodiment, the workflow comprises: providing a male component of a rotatable and wet-mateable mating connector that has conductive and non-conductive sealing elements (702); providing a female component of the rotatable and wet-mateable mating connector having conductive elements that are complementary to the male component (704); and inserting the male component into a cavity within the female component to produce the rotatable and wet-mateable mating connector (706).

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the scope of the present disclosure, and that they may make various changes, substitutions, and alterations herein without departing from the scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

While only certain embodiments have been set forth, alternatives and modifications will be apparent from the above description to those skilled in the art. These and other alternatives are considered equivalents and within the scope of this disclosure and the appended claims. Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. An apparatus, comprising: a male component having an electrically conductive male element integral to a first electrical pathway; a female component having an electrically conductive female element integral to a second electrical pathway, the female component being adapted to receive the male component; and an electrically conductive intermediary element removably disposed on the male element prior to the male component being received by the female component; wherein the intermediary element electrically connects the first electrical pathway and the second electrical pathway when the male component is received by the female component.

2. The apparatus of claim 1, wherein the removable intermediary element is a conductive O-ring.

3. The apparatus of claim 1, wherein the removable intermediary element is selected from the group consisting of an elastomer with a conductive filler, an elastomeric core metallized on its outer surface, an elastomeric core spiral wrapped with a conductive strip, and an expandable metal ring.

4. The apparatus of claim 1, further comprising a removable, non-conductive sealing element disposed on the male component axially displaced from the male element.

5. The apparatus of claim 4, wherein the removable, non-conductive sealing element comprises two removable, non-conductive sealing elements and the removable intermediary element is flanked by the two removable, non-conductive sealing elements.

6. The apparatus of claim 4, wherein the removable, non-conductive sealing element is a non-conductive O-ring.

7. The apparatus of claim 4, further comprising a non-conductive gland disposed between the male component and the removable, non-conductive sealing element.

8. The apparatus of claim 1, wherein the female component comprises a chamber having an open end and a weep hole at or near the end opposite the open end of the chamber.

9. The apparatus of claim 1, wherein the electrically conductive female element is a contact ring.

10. An apparatus, comprising:

a male component of a rotatable and wet-mateable mating connector having one or more removable conductive elements and one or more removable non-conductive sealing elements disposed on a male body, the one or more removable conductive elements and the one or more removable non-conductive sealing elements being axially and alternately spaced on the male body, and wherein one of the one or more non-conductive sealing elements is closer to a leading end of the male body than any of the one or more removable conductive elements; and a female component of the rotatable and wet-mateable mating connector having one or more female conductive elements embedded in a female body, the one or more female conductive elements being complementary to the one or more removable conductive elements of the male component, and the female body forming a chamber into which the male component is removably insertable, the one or more removable non-conductive sealing elements being in sealing engagement with the female body and the one or more removable conductive elements being in conductive engagement with the one or more female conductive elements.

11. The apparatus of claim 10, wherein each of the one or more removable conductive elements is flanked by the removable non-conductive sealing elements.

12. The apparatus of claim 10, wherein any particular removable conductive element is a conductive O-ring.

13. The apparatus of claim 10, wherein any particular removable conductive element is selected from the group consisting of an elastomer with a conductive filler, an elastomeric core metallized on its outer surface, an elastomeric core spiral wrapped with a conductive strip, and an expandable metal ring.

14. The apparatus of claim 10, further comprising one or more conductive glands axially spaced and disposed on the male body, complementary to and in electrical contact with the removable conductive elements.

15. The apparatus of claim 10, wherein any particular removable non-conductive sealing element is a non-conductive O-ring.

16. The apparatus of claim 10, further comprising one or more non-conductive glands axially spaced and disposed on the male body, complementary to and in sealing engagement with the removable non-conductive sealing elements.

17. The apparatus of claim 10, further comprising one or more male component hookup wires and one or more male component hookup wire connectors, wherein any particular male component hookup wire is electrically connected to a particular male component hookup wire connector, and any particular male component hookup wire connector is embedded in the male body and is directly or indirectly electrically connected to a particular removable conductive element.

18. The apparatus of claim 10, wherein the chamber has an open end and the female body has a weep hole at or near the end of the chamber opposite the open end.

19. The apparatus of claim 10, wherein the female conductive elements are contact rings.

20. The apparatus of claim 10, further comprising one or more female component hookup wires, wherein any particular female hookup wire is electrically connected to a particular female conductive element.

21. The apparatus of claim 10, further comprising a sleeve that sealingly houses the male component and the female component when the male component is inserted into the female component.

22. The apparatus of claim 10, further comprising a telescoping male connector assembly, a telescoping female connector assembly, or both a telescoping male connector assembly and a telescoping female connector assembly.

23. A method, comprising: providing a male component having an electrically conductive male element integral to a first electrical pathway; providing a female component having an electrically conductive female element integral to a second electrical pathway, the female component being adapted to receive the male component; providing an electrically conductive intermediary element removably disposed on the male element prior to the male component being received by the female component; and inserting the male component into the female component to electrically connect the first electrical pathway and the second electrical pathway.

24. The method of claim 23, further comprising passing electrical power or electrical signals through the connected first and second electrical pathways.

25. The method of claim 23, wherein inserting the male component into the female component comprises joining an upper drill collar having either the male component or the female component to a lower drill collar having the complementary female component or male component.

26. The method of claim 23, further comprising:

providing a removable, non-conductive sealing element disposed on the male component axially displaced from the male element and closer to a leading end of the male component than the male element; and simultaneously purging substantially all the fluid in a chamber of the female component while inserting the male component and preventing further fluid incursion into the chamber.

27. A method, comprising:

providing a male component of a rotatable and wet-mateable mating connector having one or more removable conductive elements and one or more removable non-conductive sealing elements disposed on a male body, the one or more removable conductive elements and the one or more removable non-conductive sealing elements being axially and alternately spaced on the male body, and wherein one of the one or more non-conductive sealing elements is more proximate a leading end of the male body than any of the one or more removable conductive elements;

providing a female component of the rotatable and wet-mateable mating connector having one or more female conductive elements embedded in a female body, the one or more female conductive elements being complementary to the one or more removable conductive elements of the male component, and the female body forming a chamber into which the male component is removably inserted, the one or more removable non-conductive sealing elements being in sealing engagement with the female body and the one or more removable conductive elements being in conductive engagement with the one or more female conductive elements; and inserting the male component into the chamber of the female component to produce the rotatable and wet-mateable mating connector.

28. The method of claim 27, further comprising independently passing electrical power or electrical signals through one or more electrical pathways passing through various downhole tools.

29. The method of claim 27, wherein inserting the male component comprises joining an upper drill collar having one of the rotatable and wet-mateable mating connector components to a lower drill collar having the other, complementary rotatable and wet-mateable mating connector component.

30. The method of claim 27, further comprising simultaneously purging substantially all the fluid in the chamber while inserting the male component and preventing further fluid incursion into the chamber.

31. A method, comprising: repairing a rotatable and wet-mateable mating connector having one or more removable conductive elements and one or more removable non-conductive sealing elements disposed on a male body by: removing a defective removable conductive element and/or a defective removable non-conductive sealing element from the male body while the male body is detached from a complementary female body; placing a functioning removable conductive element and/or a functioning removable non-conductive sealing element at a proper corresponding location on the male body prior to joining the male body and the female body.

32. The method of claim 31, further comprising:

removing a drillstring having a defective rotatable and wet-mateable mating connector from a wellbore;

disassembling drill collars containing the defective rotatable and wet-mateable mating connector;

removing a sleeve to expose the male body;

repairing the rotatable and wet-mateable mating connector according to the steps in claim 31;

reattaching the sleeve;

reassembling the drillstring incorporating the repaired rotatable and wet-mateable mating connector; and running the reassembled drillstring into the wellbore.

* * * * *